US008494400B2

(12) United States Patent
Kashimoto et al.

(10) Patent No.: US 8,494,400 B2
(45) Date of Patent: Jul. 23, 2013

(54) DEVELOPING DEVICE WITH MOVEABLE FLEXIBLE SHEET FOR PREVENTING TONER DEPOSITION ON DEVELOPING DEVICE CASING AND IMAGE FORMING APPARATUS INCLUDING THE SAME

(75) Inventors: Masahiro Kashimoto, Osaka (JP); Ryoji Nishimura, Osaka (JP); Hiroaki Ohashi, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 211 days.

(21) Appl. No.: 13/033,199

(22) Filed: Feb. 23, 2011

(65) Prior Publication Data

US 2011/0229184 A1 Sep. 22, 2011

(30) Foreign Application Priority Data

Mar. 18, 2010 (JP) ..... 2010-062914
Mar. 18, 2010 (JP) ..... 2010-063013

(51) Int. Cl.
*G03G 21/20* (2006.01)

(52) U.S. Cl.
USPC ..... 399/92

(58) Field of Classification Search
USPC ..... 399/92, 98, 267, 272, 274
See application file for complete search history.

(56) References Cited

U.S. PATENT DOCUMENTS

| | | | | |
|---|---|---|---|---|
| 4,723,143 | A * | 2/1988 | Enomoto | 399/254 |
| 5,953,563 | A | 9/1999 | Yamaguchi et al. | |
| 7,171,137 | B2 * | 1/2007 | Lee et al. | 399/98 |
| 7,315,717 | B2 * | 1/2008 | Mizuta | 399/283 |

FOREIGN PATENT DOCUMENTS

| | | | |
|---|---|---|---|
| JP | 09138556 | A * | 5/1997 |
| JP | 10-48948 | | 2/1998 |
| JP | 2000155457 | A * | 6/2000 |
| JP | 2002-278268 | | 9/2002 |
| JP | 2003270914 | A * | 9/2003 |
| JP | 2005031299 | A * | 2/2005 |
| JP | 2006064740 | A * | 3/2006 |
| JP | 2006208444 | A * | 8/2006 |

* cited by examiner

*Primary Examiner* — Robert Beatty
(74) *Attorney, Agent, or Firm* — Smith, Gambrell & Russell, LLP

(57) ABSTRACT

A developing device includes: a developer carrying member for supplying a developer to an image bearing member at an opposing region opposing to the image bearing member, the developer carrying member being arranged so as to be opposed to the image bearing member on which an electrostatic latent image is to be formed; a blade for regulating an amount of the developer carried on the developer carrying member; a casing for housing the developer carrying member and the blade, the casing including a wall portion opposed to the developer carrying member between the blade and the opposing region; a sheet member that is flexible, provided on the wall portion, has a free end, forms a part of an inner wall surface of the wall portion, and is movable in a direction perpendicular to the inner wall surface; and a moving portion provided on the wall portion, for moving the sheet member.

9 Claims, 16 Drawing Sheets

DEVELOPING DEVICE WITH MOVEABLE FLEXIBLE SHEET FOR PREVENTING TONER DEPOSITION ON DEVELOPING DEVICE CASING AND IMAGE FORMING APPARATUS INCLUDING THE SAME

This application is based upon and claims the benefit of priority from the corresponding Japanese Patent Application No. 2010-62914 filed on Mar. 18, 2010 and Japanese Patent Application No. 2010-63013 filed on Mar. 18, 2010, the entire contents of which are incorporated herein by reference.

BACKGROUND OF THE INVENTION

1. Field of the Invention

The present invention relates to an electrophotographic image forming apparatus including an image bearing member and a developing device.

2. Description of Related Art

An electrophotographic image forming apparatus irradiates a circumferential surface of an image bearing member (photosensitive drum) with light based on image information which is obtained by reading an image of a document and transmitted from an external instrument such as a computer. Accordingly, the electrophotographic image forming apparatus forms an electrostatic latent image, supplies the electrostatic latent image with toner to form a toner image, and thereafter, transfers the toner image to a sheet. The sheet subjected to such transfer processing is then subjected to fixing processing of the toner image, and is thereafter delivered to the outside.

By the way, in recent years, in the image forming apparatus, an apparatus structure thereof has become complicated as color printing has been increased and a processing speed has been enhanced, and in addition, high speed rotation of a toner stirring member in a developing device has been forced in order to cope with such enhancement of the processing speed. In this case, a pressure inside the developing device is prone to be a positive pressure higher than the atmospheric pressure. When the pressure inside the developing device becomes the positive pressure, in the event where the toner is supplied from the inside of the developing device to the photosensitive drum, a part of the toner becomes floating toner and is discharged from a toner supply port to the photosensitive drum, to thereby contaminate an inside of an apparatus main unit of the image forming apparatus. In addition, necessary toner becomes less likely to be supplied to the electrostatic latent image. As a result, such a malfunction becomes prone to occur, that there occurs a so-called toner lack phenomenon in which the toner is not supplied to a portion on the circumferential surface of the photosensitive drum, on which the toner should be stacked.

In this connection, a variety of developing devices are known, which are improved so as to become capable of preventing leakage of the toner. For example, in a developing device that we will refer to as Related art 1, in a casing inside thereof, there are provided a stirring roller and a developing roller, the developing roller being arranged on a downstream side of the stirring roller and supplying the toner to the circumferential surface of the photosensitive drum. The stirring member is arranged at a little upper position than a bottom plate of the casing, and the developing roller is arranged at an obliquely upper position of the stirring member.

Then, at an upper position of the stirring member, a partition plate is obliquely provided, which guides the toner so that the toner can flow toward a circumferential surface of the developing roller. Owing to the presence of this partition plate, an inside of the casing is divided up and down into halves. The toner above the partition plate passes through a gap between a lower end edge portion of the partition plate concerned and the bottom plate of the casing, and is supplied to a space below the partition plate. The toner supplied here is subsequently drawn up onto the circumferential surface of the developing roller by drive/rotation of the stirring roller, and is supplied from the circumferential surface of the developing roller to the circumferential surface of the photosensitive drum.

In the developing device as described above, a vent hole is drilled in the partition plate, and thus it is made possible to take out air in the space below the partition plate, of which pressure has become the positive pressure by the rotation of the stirring roller, through the vent hole concerned to a space above the partition plate. In such a way, a pressure in such a space where the stirring roller is provided is decreased. Accordingly, air containing the floating toner is stopped being discharged to the outside from a toner discharge port. As a result, the leakage of the floating toner from the toner discharge port can be prevented.

Meanwhile, it is known that, in a developing device that we will refer to as Related art 2, air in a gap between a toner carrying member and a covering member that covers a part of an outer circumferential surface of the toner carrying member is forcibly sucked, whereby scattering of the toner and heat generation of the developing device are suppressed even if a speed of a developing process is enhanced.

By the way, in the developing device of Related art 1, the air containing the floating toner, which is present in the space below the partition plate in the casing, passes through the vent hole drilled in the partition plate, and is caused to flow toward the space above the partition plate, and in this case, a flowing direction of the air is substantially orthogonal to a transporting direction of the toner fed onto the photosensitive drum by the rotation of the developing roller.

Therefore, in many cases, strength of an airflow attempting to go toward the vent hole is not so strong as to cancel a flow of air attempting to accompany the rotation of the developing roller. As a result, there is a problem in that the air containing the floating toner becomes prone to flow toward the circumferential surface of the photosensitive drum by the rotation of the developing roller, resulting in leakage of the air concerned from a toner supply opening of the casing opposed to the same circumferential surface.

Further, in the developing device, in some case, the toner that has scattered is deposited on the periphery of an ear cutting blade. In the case where the deposited toner is aggregated and adhered onto the developing roller, there is also an apprehension that such a toner lack may occur to cause a malfunction of the image.

Accordingly, for example, as illustrated in FIG. 16, in the developing device, it is conceived to provide an air inflow port, which is for taking in air from the outside of the developing device, in a wall portion of a developing container, which is opposed to the developing roller. FIG. 16 is a schematic sectional side view illustrating a structure of the periphery of the developing device in which the air inflow port is provided. As illustrated in FIG. 16, in a developing container 20 of a developing device 3*a*, there are provided a stirring-transport screw 25*a*, a supplying-transport screw 25*b*, a magnetic roller 30, and a developing roller 31.

A developer containing toner and a carrier, which is stirred and transported by the stirring-transport screw 25*a*, is supplied to the magnetic roller 30, which rotates clockwise in FIG. 16, by the supplying-transport screw 25*b*. Then, the developer forms a magnetic brush on the magnetic roller 30.

Only the toner in the magnetic brush on the magnetic roller 30 is carried on the developing roller 31 rotating clockwise in FIG. 16, and the toner is supplied to a photosensitive drum 1*a* from the developing roller 31.

In a space on a left side of the magnetic roller 30 and the developing roller 31 and also above an ear cutting blade 35, airflows as illustrated by broken lines are individually generated by the clockwise rotation of the magnetic roller 30 and the developing roller 31, the two airflows illustrated by the broken lines join together, and as a whole, an airflow going upward as illustrated by a solid line is generated. Therefore, even in the case where the floating toner is present in the vicinity of the ear cutting blade 35, the toner can be prevented from being deposited on the ear cutting blade 35 by bearing the floating toner on this airflow.

Therefore, in the developing container 20, a wall portion 20*c* protruding inward is provided above the ear cutting blade 35 in FIG. 16, and two air inflow ports 51*a* and 51*b* are provided in the wall portion 20*c*. Thus, an airflow flowing inside the developing container 20 from outside flows into the vicinity of the ear cutting blade 35, in which a pressure becomes negative by the generation of the airflow illustrated by the solid line.

By such inflow of the airflow, it becomes possible to decrease a pressure of the portion, which has become positive by the rotation of the magnetic roller 30 and the developing roller 31. Further, the airflow that has flowed in connects to the airflow going upward, and hence the floating toner in the vicinity of the ear cutting blade 35 is borne on the airflow going upward, thus making it possible to prevent the toner from being deposited on the ear cutting blade 35.

However, even in the case where the air inflow ports are provided as described above, in the case where the processing speed of the apparatus main unit is enhanced, and a floating amount of the toner is large, it becomes difficult to sufficiently bear the floating toner on the airflow generated by the rotation of the magnetic roller and the developing roller, and it becomes difficult to sufficiently prevent the deposition of the toner.

Further, in the developing device of Related art 2, the toner supplied from the stirring screw onto the developing roller is supplied to the photosensitive drum, and such a technology is not used, in which the toner is carried on the developing roller from the stirring screw through the magnetic roller, and the toner is supplied to the photosensitive drum. Further, depending on whether or not the magnetic roller is present, the portion in the developing device, in which the positive pressure is generated, is changed as well as a magnitude of the positive pressure.

SUMMARY OF THE INVENTION

It is an object of the present invention to provide a developing device capable of effectively preventing deposition of toner in a casing, and to provide an image forming apparatus including the developing device.

A developing device according to one aspect of the present invention includes a toner carrying member, a toner supply member, a blade, a casing, a sheet member, and a moving portion. The toner carrying member supplies toner to an image bearing member at an opposing region opposing the image bearing member, and is arranged so as to be opposed to the image bearing member on which an electrostatic latent image is to be formed. The toner supply member supplies only the toner to the toner carrying member, and has a developer containing the toner and a carrier carried thereon. The blade regulates the amount of developer carried on the toner supply member. The casing houses the toner carrying member, the toner supply member, and the blade, and includes a wall portion opposed to the toner carrying member between the blade and the opposing region. The sheet member is flexible, is provided on the wall portion, has a free end, forms a part of the inner wall surface of the wall portion, and is movable in a direction perpendicular to the inner wall surface. The moving portion is provided on the wall portion, and moves the sheet member.

An image forming apparatus according to another aspect of the present invention includes a developing device configured as described above, an image bearing member on which an electrostatic latent image is to be formed, a through hole, an exhaust portion, and an air exhaust port. The through hole is arranged in the wall portion, and allows the inside of the casing and the outside of the casing to communicate with each other. The exhaust portion has a duct, and exhausts air in the casing to the outside of the apparatus main unit. The air exhaust port is arranged in an upper end portion of the casing and also above the opposing part between the toner carrying member and the toner supply member, and communicates to the duct.

An image forming apparatus according to yet another aspect of the present invention includes a developer carrying member, a blade, a casing, a sheet member, and a moving portion. The developer carrying member is arranged so as to be opposed to an image bearing member on which an electrostatic latent image is to be formed, and supplies a developer to the image bearing member at an opposing region opposing to the image bearing member. The blade regulates the amount of developer carried on the developer carrying member. The casing houses the developer carrying member and the blade, and includes a wall portion opposed to the developer carrying member between the blade and the opposing region. The sheet member is provided on the wall portion, has a free end, forms a part of the inner wall surface of the wall portion, is movable in a direction perpendicular to the inner wall surface, and is flexible. The moving portion is provided on the wall portion, and moves the sheet member.

Further features and advantages of the present invention will become apparent from the description of embodiments given below.

DETAILED DESCRIPTION OF PREFERRED EMBODIMENTS

Figure 1:
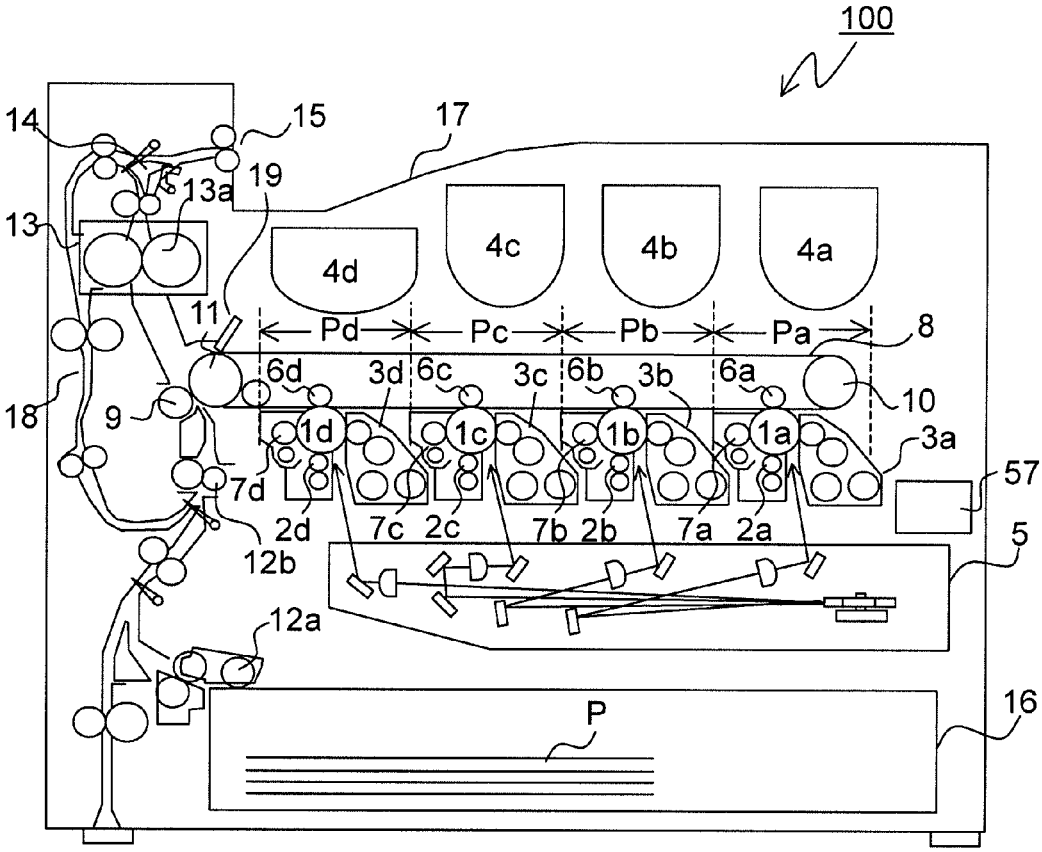
FIG. 1 is a schematic structural view of an image forming apparatus including a developing device according to an embodiment of the present invention.

Hereinafter, embodiments of the present invention are described with reference to the accompanying drawings. FIG. 1 is a sectional schematic view of an image forming apparatus to which a developing device according to the present invention is mounted, illustrating here a tandem color image forming apparatus. Four image forming portions Pa, Pb, Pc, and Pd are disposed in order from an upstream side in a transporting direction (right side in FIG. 1) in a color printer 100 main unit. Those image forming portions Pa to Pd are provided corresponding to images in different four colors (cyan, magenta, yellow, and black), and respectively form the images in cyan, magenta, yellow, and black successively by respective steps of charging, exposure, development, and transfer.

Photosensitive drums 1*a*, 1*b*, 1*c*, and 1*d* which carry visual images (toner images) in the respective colors thereon are disposed in the image forming portions Pa to Pd, respectively. In addition, an intermediate transfer belt 8 caused to rotate clockwise in FIG. 1 by drive means (not shown) is provided adjacent to the respective image forming portions Pa to Pd. The toner images formed on those photosensitive drums 1*a* to 1*d* are sequentially primarily transferred onto the intermediate transfer belt 8 moving in abutment with the respective photosensitive drums 1*a* to 1*d* so as to be superimposed one on another, and then secondarily transferred onto a transfer paper sheet P being an example of a recording medium by action of a secondary transfer roller 9. In addition, the toner images are fixed to the transfer paper sheet P at a fixing portion 13, and are then discharged from the apparatus main unit. An image forming process is executed on the respective photosensitive drums 1*a* to 1*d* while the photosensitive drums 1*a* to 1*d* are caused to rotate counterclockwise in FIG. 1.

The transfer paper sheet P onto which the toner images are transferred is received within a sheet cassette 16 in a lower portion of the apparatus, and conveyed via a sheet feeding roller 12*a* and a registration roller pair 12*b* to a nip portion formed between the secondary transfer roller 9 and a drive roller 11 of the intermediate transfer belt 8 described later. A sheet made of a dielectric resin is used for the intermediate transfer belt 8, and a (seamless) belt having no seam is mainly used. Further, a blade-like belt cleaner 19 for removing the toner and the like remaining on a surface of the intermediate transfer belt 8 is located on a downstream side of the secondary transfer roller 9.

Next, descriptions are made of the image forming portions Pa to Pd. Provided around and below the photosensitive drums 1*a* to 1*d* disposed so as to be free to rotate are: chargers 2*a*, 2*b*, 2*c*, and 2*d* for charging the photosensitive drums 1*a* to 1*d*, respectively; an exposure device 5 for performing exposure based on image data with respect to the respective photosensitive drums 1*a* to 1*d*; developing units 3*a*, 3*b*, 3*c*, and 3*d* for forming toner images on the photosensitive drums 1*a* to 1*d*, respectively; and cleaning portions 7*a*, 7*b*, 7*c*, and 7*d* for removing developers (toner) and the like remaining on the photosensitive drums 1*a* to 1*d*, respectively.

When image data is input from a host unit such as a personal computer, the chargers 2*a* to 2*d* first charge surfaces of the photosensitive drums 1*a* to 1*d* uniformly, and then the exposure device 5 applies light correspondingly to the image data to form electrostatic latent images corresponding to the image data on the respective photosensitive drums 1*a* to 1*d*. The developing devices 3*a* to 3*d* are filled with predetermined amounts of two-component developers containing the respective colors of toner, that is, cyan, magenta, yellow, and black, respectively. Note that, the respective developing devices 3*a* to 3*d* are replenished with developers (toner and carriers) from respective toner containers (replenishing means) 4*a* to 4*d* in a case where the proportion of toner within the two-component developers filling the respective developing devices 3*a* to 3*d* falls below a preset value because of formation of the toner image described later. The toner within the developer is supplied onto the photosensitive drums 1*a* to 1*d* by the developing devices 3*a* to 3*d*, and electrostatically adheres thereto. Thus formed are the toner images corresponding to the electrostatic latent images formed by the exposure performed by the exposure device 5.

Then, by applying a predetermined transfer voltage to primary transfer rollers 6*a* to 6*d*, the toner images in yellow, cyan, magenta, and black on the photosensitive drums 1*a* to 1*d*, respectively, are primarily transferred onto the intermediate transfer belt 8. The toner images in four colors are formed to have a predetermined positional relationship that is previously defined for forming a predetermined full-color image. After that, in preparation for the formation of new electrostatic latent images to be subsequently performed, the toner and the like remaining on the surfaces of the photosensitive drums 1*a* to 1*d* are removed by the cleaning portions 7*a* to 7*d*, respectively.

The intermediate transfer belt 8 is stretched around a conveyance roller 10 on an upstream side thereof and the drive roller 11 on a downstream side thereof. When the intermediate transfer belt 8 starts to rotate clockwise in accordance with the rotation of the drive roller 11 caused by a drive motor (not shown), the transfer paper sheet P is conveyed from the registration roller pair 12*b* at a predetermined timing to a nip portion (secondary transfer nip portion) between the drive roller 11 and the secondary transfer roller 9 provided adjacent thereto, and a full-color toner image on the intermediate transfer belt 8 is transferred onto the transfer paper sheet P. The transfer paper sheet P onto which the toner image has been transferred is conveyed to the fixing portion 13.

The transfer paper sheet P conveyed to the fixing portion 13 is heated and pressurized by a fixing roller pair 13*a*, and the toner images are fixed to a surface of the transfer paper sheet P to form a predetermined full-color image. The transfer paper sheet P on which the full-color image has been formed is directed toward one of a plurality of conveying directions branched from a branch portion 14. In a case where an image is formed on only one surface of the transfer paper sheet P, the transfer paper sheet P is delivered to a delivery tray 17 by delivery rollers 15 as it is.

On the other hand, in a case where images are formed on both surfaces of the transfer paper sheet P, the transfer paper sheet P that has passed through the fixing portion 13 is temporarily conveyed toward the delivery rollers 15. Then, after a trailing end of the transfer paper sheet P passes through the branch portion 14, the delivery rollers 15 are caused to rotate reversely, and a conveying direction of the branch portion 14 is switched over. Accordingly, the transfer paper sheet P has the trailing end directed toward a sheet conveyance path 18, and is again conveyed to the secondary transfer nip portion under a state in which an image surface is reversed. Then, the next image formed on the intermediate transfer belt 8 is transferred onto a surface of the transfer paper sheet P on which no image is formed by the secondary transfer roller 9. Then, the paper sheet P is conveyed to the fixing portion 13, has the toner images fixed thereto, and is delivered to the delivery tray 17.

Further, an exhaust fan 57 is provided on a back surface side of the apparatus main unit, and the exhaust fan 57 exhausts air inside the apparatus main unit to the outside of the apparatus main unit.

Figure 2:
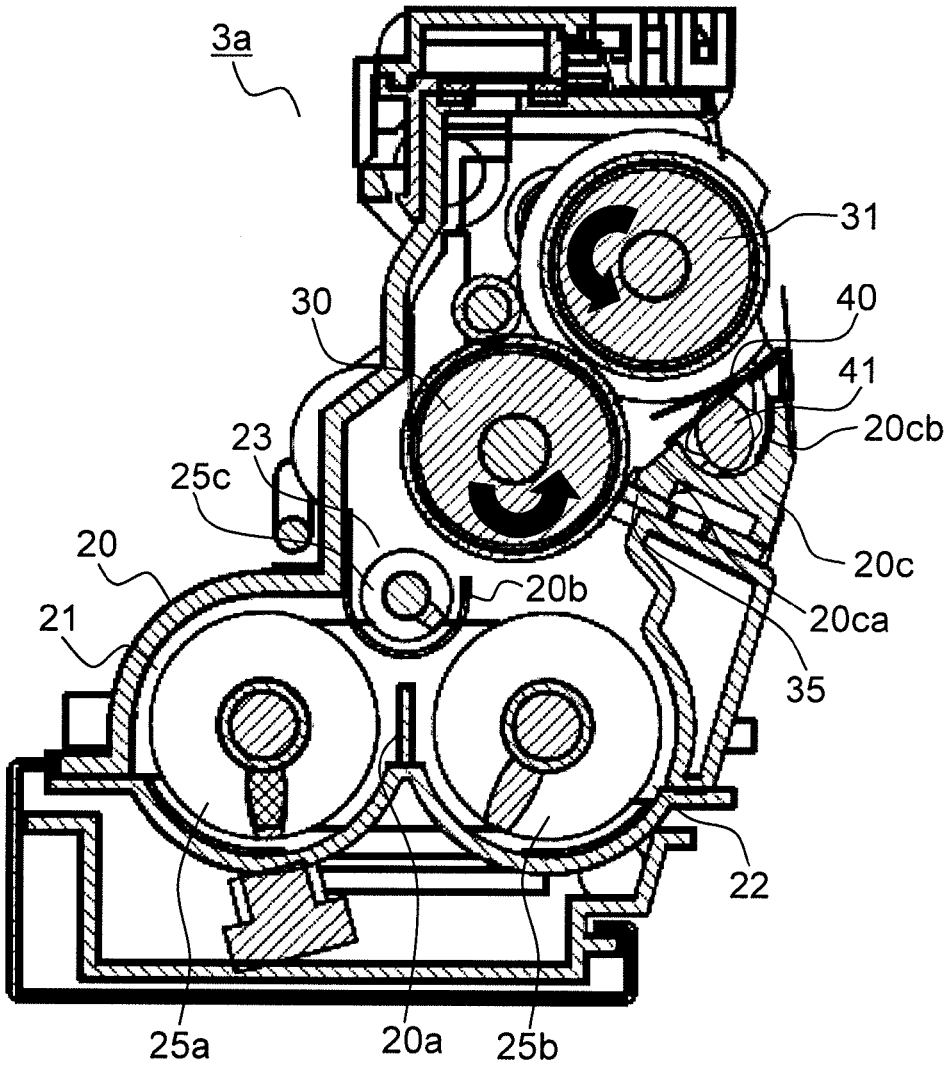
FIG. 2 is a sectional side view illustrating a developing device according to a first embodiment of the present invention.

FIG. 2 is a schematic sectional side view of a developing device according to a first embodiment of the present invention. Note that, FIG. 2 indicates a state viewed from a back surface side of FIG. 1, and the respective members within the developing device are arranged so as to be horizontally reverse to FIG. 1. Further, the description here is directed to the developing device 3*a* located in the image forming portion Pa of FIG. 1, but the developing devices 3*b* to 3*d* located in the image forming portions Pb to Pd, respectively, basically have the same structure as the developing device 3*a*, and hence description thereof is omitted.

As illustrated in FIG. 2, the developing device 3*a* includes a developing container (casing) 20 for storing a two-component developer (hereinafter, referred to simply as "developer"), and the developing container 20 is partitioned by partition walls 20*a* and 20*b* into a stirring-transport chamber 21, a supplying-transport chamber 22, and a collecting-transport chamber 23. Rotatably disposed in the stirring-transport chamber 21 and the supplying-transport chamber 22 are a stirring-transport screw 25*a* and a supplying-transport screw 25*b*, respectively, for mixing toner (positively charged toner) supplied from the toner container 4*a* (see FIG. 1) with a carrier, stirring the mixture, and causing the mixture to be charged. Further, a collecting-transport screw 25*c* for transporting the developer scraped off from a magnetic roller 30 (described later) is rotatably disposed in the collecting-transport chamber 23 which is provided above the supplying-transport chamber 22 and the stirring-transport chamber 21 near the boundary therebetween.

Then, the developer is transported in axial directions (directions perpendicular to the sheet plane of FIG. 2) by the stirring-transport screw 25*a* and the supplying-transport screw 25*b* while being stirred thereby, and is caused to circulate between the stirring-transport chamber 21 and the supplying-transport chamber 22 via developer passages (not shown) that are formed in both end portions of the partition wall 20*a*. Further, the developer scraped off from the magnetic roller 30 (described later) is transported in the axial direction by the collecting-transport screw 25*c*, and is merged into the developer within the supplying-transport chamber 22 from a communication portion (not shown) formed at one end of the partition wall 20*b*. That is, the stirring-transport chamber 21, the supplying-transport chamber 22, the collecting-transport chamber 23, the developer passages, and the communication portion form a circulating path for the developer within the developing container 20.

The developing container 20 extends obliquely upward to the right in FIG. 2. In the developing container 20, the magnetic roller 30 is located above the supplying-transport screw 25*b*, and a developing roller (developer carrying member) 31 is opposedly located obliquely upward to the right of the magnetic roller 30. Further, the developing roller 31 is opposed to the photosensitive drum 1*a* (see FIG. 1) on an opening side (right side of FIG. 2) of the developing container 20. With regard to rotational directions about the respective rotary shafts, the magnetic roller 30 is caused to rotate counterclockwise in the figure, while the developing roller 31 is caused to rotate counterclockwise in the figure.

In the stirring-transport chamber 21, a toner density sensor (not shown) is located so as to face the stirring-transport screw 25*a*. Based on a detection result of the toner density sensor, the toner is replenished to the stirring-transport chamber 21 from the toner container 4*a* through a toner replenishing port (not shown). As the toner density sensor, for example, a magnetic permeability sensor is used, which detects magnetic permeability of a two-component developer containing the toner and a magnetic carrier within the developing container 20.

The magnetic roller 30 includes a non-magnetic rotation sleeve that rotates counterclockwise in FIG. 2 and a fixed magnetic body provided inside the rotation sleeve and having a plurality of magnetic poles.

The developing roller 31 includes a cylindrical-shaped developing sleeve that rotates counterclockwise in FIG. 2 and a developing roller side magnetic pole fixed to an inside of the developing sleeve. The magnetic roller 30 and the developing roller 31 are opposed to each other in a facing position (opposing position) with a predetermined gap. The developing roller side magnetic pole has an opposite polarity to the opposing magnetic pole (main pole) of the fixed magnetic body.

Further, an ear cutting blade 35 is attached to the developing container 20 along a longitudinal direction (direction perpendicular to the sheet plane of FIG. 2) of the magnetic roller 30, and the ear cutting blade 35 is positioned on an upstream side of the opposing position between the developing roller 31 and the magnetic roller 30 in a rotational direction (counterclockwise in the figure) of the magnetic roller 30. Further, a slight clearance (gap) is formed between a tip portion of the ear cutting blade 35 and a surface of the magnetic roller 30.

A direct current voltage (hereinafter, referred to as "Vslv (DC)") and an alternating current voltage (hereinafter, referred to as "Vslv (AC)") are applied to the developing roller 31, while a direct current voltage (hereinafter, referred to as "Vmag (DC)") and an alternating current voltage (hereinafter, referred to as "Vmag (AC)") are applied to the magnetic roller 30. Those direct current voltages and alternating current voltages are applied to the developing roller 31 and the magnetic roller 30 from a developing bias power source (not shown) through a bias control circuit (not shown).

As described above, while stirring the developer, the stirring-transport screw 25*a* and the supplying-transport screw

25*b* cause the developer to circulate in the stirring-transport chamber 21 and the supplying-transport chamber 22 within the developing container 20 so as to charge the toner, and the developer is transported to the magnetic roller 30 by the supplying-transport screw 25*b*. Then, the magnetic roller 30 has a magnetic brush (not shown) formed thereon, and the magnetic brush on the magnetic roller 30 has its layer thickness regulated by the ear cutting blade 35. After that, the magnetic brush is conveyed to an opposing part between the magnetic roller 30 and the developing roller 31, and a toner thin layer is formed on the developing roller 31 based on a potential difference ΔV between Vmag (DC) applied to the magnetic roller 30 and Vslv (DC) applied to the developing roller 31, and a magnetic field.

A toner layer thickness on the developing roller 31 also changes in accordance with a resistance of the developer, a difference in rotational speed between the magnetic roller 30 and the developing roller 31, and the like, but can be controlled based on the potential difference ΔV. A toner layer on the developing roller 31 becomes thicker with a larger potential difference ΔV and becomes thinner with a smaller potential difference ΔV. In general, an appropriate range of the potential difference ΔV at the time of the development is approximately 100 V to 350 V.

The toner thin layer formed on the developing roller 31 by the magnetic brush is transported by the rotation of the developing roller 31 to the opposing part (opposing region) between the photosensitive drum 1*a* and the developing roller 31. Vslv (DC) and Vslv (AC) are applied to the developing roller 31, and hence the toner flies due to a potential difference from the photosensitive drum 1*a*, and the electrostatic latent images on the photosensitive drum 1*a* are developed.

The remaining toner that has not used for the development is again transported to the opposing part between the developing roller 31 and the magnetic roller 30, and is collected by the magnetic brush on the magnetic roller 30. After being scraped off from the magnetic roller 30 in a homopolar portion of a fixed magnetic body, the magnetic brush falls into the collecting-transport chamber 23. The developer within the collecting-transport chamber 23 is transported in the axial direction by the collecting-transport screw 25*c*, and is merged into the developer within the supplying-transport chamber 22 from the communication portion (not shown).

After that, the developer is replenished with a predetermined amount of toner through the toner replenishing port (not shown) based on the detection result from the toner density sensor (not shown), and while circulating through the supplying-transport chamber 22 and the stirring-transport chamber 21, becomes the two-component developer uniformly charged with an optimal toner density again. The above-mentioned developer is again supplied onto the magnetic roller 30 by the supplying-transport screw 25*b*, to thereby form the magnetic brush, and is transported to the ear cutting blade 35.

Figure 3:
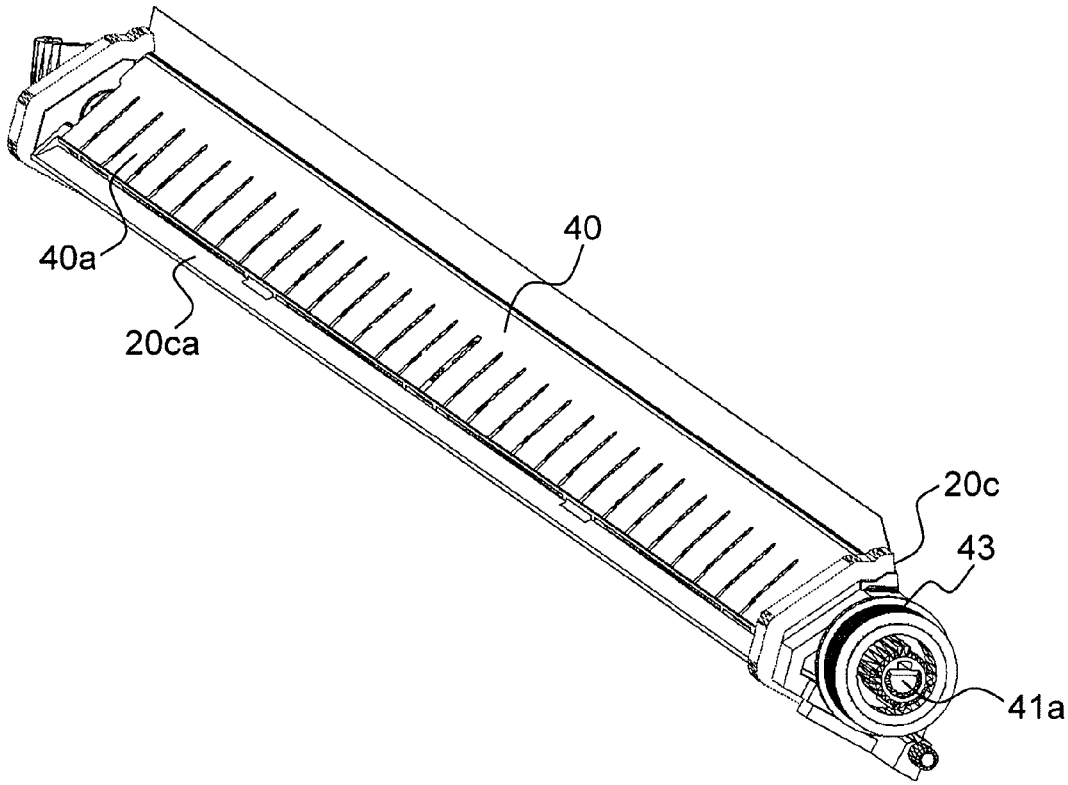
FIG. 3 is a schematic perspective view illustrating a film member and an oval roller, which are provided on a wall portion, according to the embodiment of the present invention.
Figure 4:
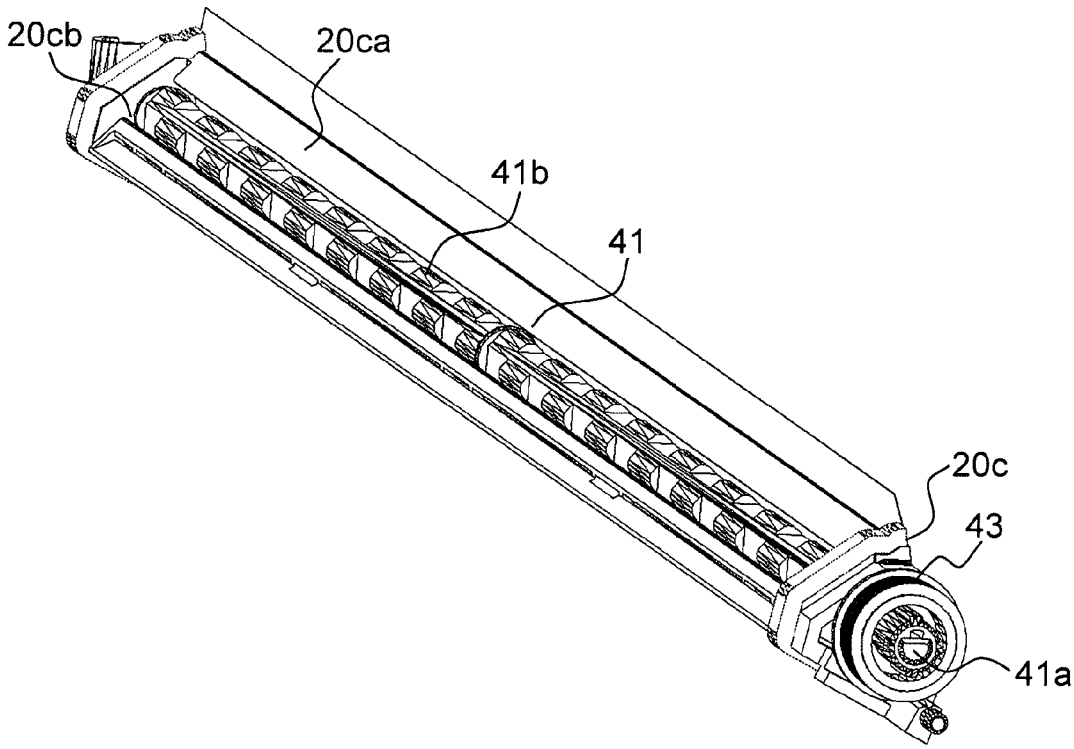
FIG. 4 is a view, in which the film member is omitted from FIG. 3, according to the embodiment of the present invention.
Figure 5:
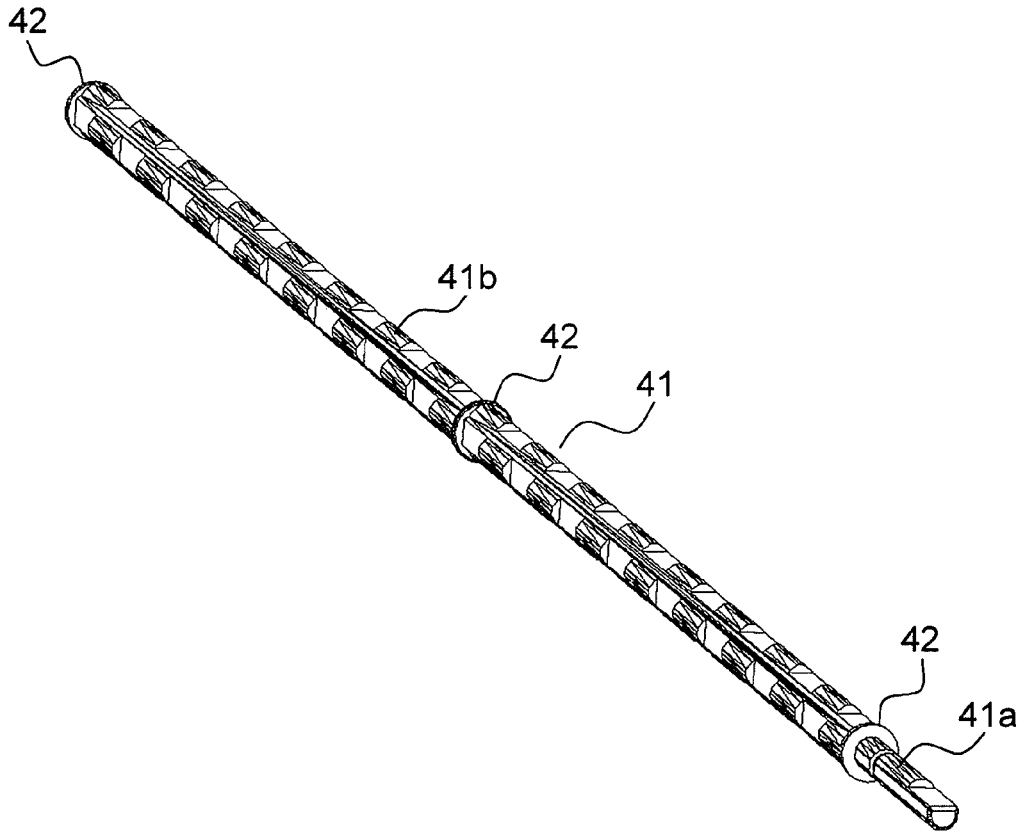
FIG. 5 is a perspective view illustrating the oval roller according to the embodiment of the present invention.
Figure 6:
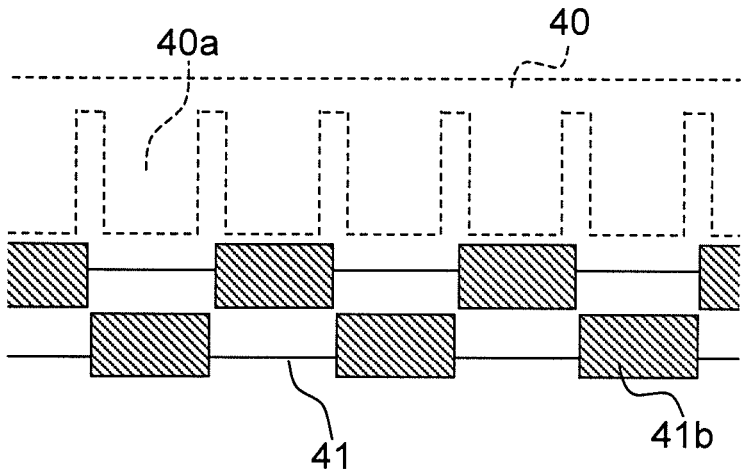
FIG. 6 is a view illustrating an arrangement relationship between piece portions and protruding portions according to the embodiment of the present invention.
Figure 7:
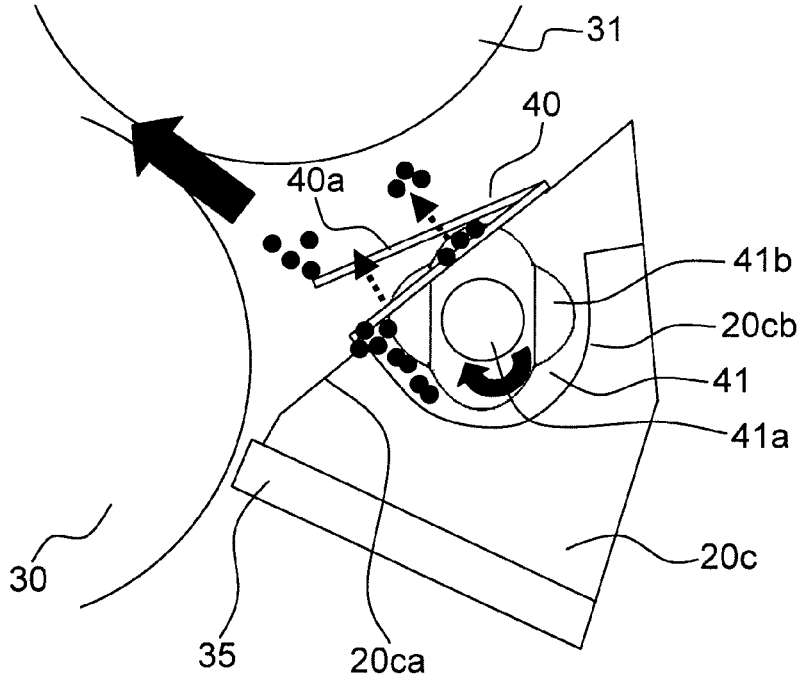
FIG. 7 is a schematic side view illustrating operations of the film member and the oval roller according to the embodiment of the present invention.

FIG. 3 is a schematic perspective view illustrating a film member and an oval roller, which are provided on a wall portion, FIG. 4 is a view in which the film member is omitted from FIG. 3, FIG. 5 is a perspective view illustrating the oval roller, FIG. 6 is a view illustrating an arrangement relationship between piece portions and protruding portions, and FIG. 7 is a schematic side view illustrating operations of the film member and the oval roller. Reference symbols common to those in FIG. 2 are assigned to portions common to those therein, and a description of the common portions is omitted.

A wall portion 20*c* protruding inward is provided in the vicinity of the developing roller 31 on a right side wall in FIG. 2 in the developing container 20. As illustrated in FIG. 2 and FIG. 3, the wall portion 20*c* is formed along a longitudinal direction (direction perpendicular to the sheet plane of FIG. 2), and an inner wall surface 20*ca* of the wall portion 20*c* is inclined downward. On the wall portion 20*c*, a recessed portion 20*cb* recessed from the inner wall surface 20*ca* side is formed along the longitudinal direction.

On an upper end portion of the inner wall surface 20*ca*, a film member (sheet member) 40 having a free end is supported along the longitudinal direction. The film member 40 is arranged so as to cover the recessed portion 20*cb*, and constitutes a part of the inner wall surface 20*ca*. The film member 40 is formed of a flexible material such as a resin, for example, a PET film, and is arranged along the longitudinal direction as illustrated in FIG. 3.

The film member 40 is divided into a plurality of piece portions (sheet pieces) 40*a* along the longitudinal direction. The respective piece portions 40*a* are formed at a fixed width. Further, the respective piece portions 40*a* are made movable up and down by being pressed from below against the inner wall surface 20*ca* by protruding portions 41*b* formed on an oval roller 41 described later.

In the recessed portion 20*cb*, the oval roller (moving portion) 41 is provided along the longitudinal direction. On one axial end portion of a rotation shaft 41*a* of the oval roller 41, a drive transmitting gear 43 coupled to a drive motor (not shown) is provided, and the oval roller 41 rotates in such a manner that rotational drive from the drive motor is transmitted thereto.

As illustrated in FIG. 4 and FIG. 5, on circumferential surfaces of roller bodies of the oval roller 41, the protruding portions 41*b* in a plurality of rows are formed along an axial direction (longitudinal direction). The protruding portions 41*b* are formed into the same shape, and are formed while being alternately angled so that the protruding portions 41*b*, which are the mutually nearest across boundaries between the rows, cannot overlap one another. Specifically, intervals of the protruding portions 41*b* in the axial direction and a circumferential direction are set at intervals separated by one protruding portion 41*b*. Further, four protruding portions 41*b* are formed along the circumferential direction (see FIG. 7). Specifically, a cross section of the oval roller 41 includes two ovals orthogonal to each other.

Further, as illustrated in FIG. 6, the protruding portions 41*b* are arranged at positions opposed to the piece portions 40*a* of the film member 40, which are arranged in the longitudinal direction (right and left direction in FIG. 6). A size of the oval roller 41 and a protruding length of the protruding portions 41*b* are set at such a size and a length that allow, by rotation of the oval roller 41, the protruding portions 41*b* to push up the piece portions 40*a* when the protruding portions 41*b* abut against the piece portions 40*a* and to release the push up when the protruding portions 41*b* leave the piece portions 40*a*.

Here, two roller bodies of the oval roller 41 are inserted along the axial direction of the rotation shaft 41*a*, and stop rings 42 are attached therebetween and on both sides thereof, and thus the oval roller 41 is formed. However, the roller bodies and rotation shaft 41*a* of the oval roller 41 can also be formed integrally with each other.

Then, as illustrated in FIG. 7, when each of the protruding portions 41*b* in an arbitrary axial row reaches a position abutting against the piece portion 40*a* opposed thereto by the rotation of the oval roller 41, the protruding portion 41*b* pushes the piece portion 40*a* upward with respect to the inner wall surface 20*ca*. When the oval roller 41 further rotates, the protruding portion 41*b* releases such push up for the piece portion 40*a*, and each of the protruding portions 41*b* in the next axial row pushes up a piece portion 40*a* adjacent to the piece portion 40*a* for which the push up is released.

Figure 16:
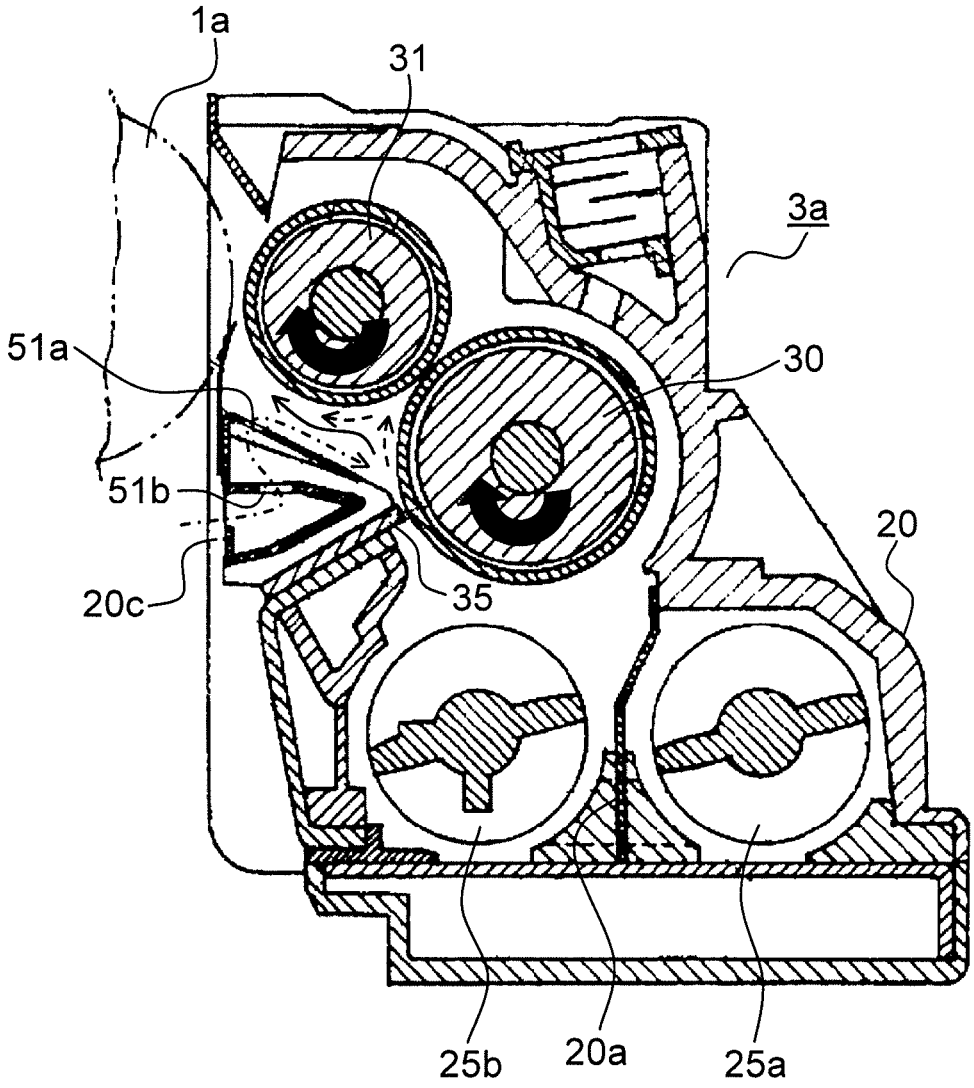
FIG. 16 is a schematic sectional side view illustrating a developing device in which air inflow ports are provided in a wall portion of a developing container.

This is sequentially repeated, and thus the piece portions 40*a* vibrate in a direction perpendicular to the inner wall surface 20*ca*. By such vibrations, the piece portions 40*a* can separate the toner, which floats around the inner wall surface 20*ca*, from the wall portion 20*c*, can bear the toner on an airflow (see the solid arrow in FIG. 16) generated by the rotation of the developing roller 31 and the magnetic roller 30, and can prevent the deposition of the toner on the wall portion 20*c*.

As described above, the developing container 20 is configured to include the wall portion 20*c*, which is opposed to the developing roller 31, between the ear cutting blade 35 and the opposing region between the photosensitive drum 1*a* and the developing roller 31. In the wall portion 20*c*, there are provided: the flexible film member 40 which has the free end and is movable in the direction perpendicular to the inner wall surface 20*ca* of the wall portion 20 while contacting to the toner in the developing container 20; and the oval roller 41 that moves the film member 40 concerned. Accordingly, by the vibrations of the film member 40, the toner floating toward the wall portion 20*c* can be separated from the wall portion 20*c*, and can be borne on the airflow generated by the rotation of the developing roller 31 and the magnetic roller 30. In addition, the deposition of the toner on the wall portion 20*c* can be prevented. In such a way, the deposition of the toner in the developing container 20 of the developing device 3*a* can be effectively prevented.

Further, in this embodiment, the recessed portion 20*cb* recessed from the inner wall surface 20*ca* is formed in the wall portion 20*c*, and the oval roller 41 is provided in the recessed portion 20*cb*. Further, the film member 40 is arranged at the position of covering the recessed portion 20*cb*, and is configured to be pressed against the circumferential surface of the oval roller 41. Accordingly, a simple structure can be adopted. However, besides the above, the film member 40 can also be made movable by using a solenoid and the like without providing the recessed portion 20*cb* when the solenoid and the like are capable of moving the film member 40. Further, the film member 40 and the oval roller 41 are not particularly limited to this embodiment.

Further, in this embodiment, on the circumferential surface of the oval roller 41, the plurality of protruding portions 41*b* with substantially the same shape are formed along the circumferential direction and the axial direction while being alternately angled. Accordingly, the entire region of the film member 40 is not pressed simultaneously in the axial direction by the protruding portions 41*b*. In such a way, a load applied on the film member 40 can be reduced. Further, the toner can be separated from the wall portion 20*c* more effectively because the film member 40 vibrates like waving in the axial direction.

In particular, in this embodiment, the film member 40 is divided into the plurality of piece portions 40*a* in the axial direction, and an axial length of each of the piece portions 40*a* is set as the same as an axial length of each of the protruding portions 41*b*, and the plurality of piece portions 40*a* are formed at the positions overlapping the plurality of protruding portions 41*b* in the axial direction. Accordingly, only the piece portions pressed by the protruding portions 41*b* in the axial direction are pressed. In such a way, the load applied on the film member 40 can be further reduced.

Further, each of the piece portions 40*a* vibrates independently of the piece portion 40*a* adjacent thereto, and accordingly, interference thereof with the adjacent piece portion 40*a* is prevented, and hence the toner can be separated from the wall portion 20*c* more effectively. Note that, shapes, sizes, arrangement, and the like of the piece portions 40*a* and the protruding portions 41*b* can be appropriately set depending on a separated state of the toner from the wall portion 20*c*, and the like, and are not particularly limited to this embodiment.

Figure 8:
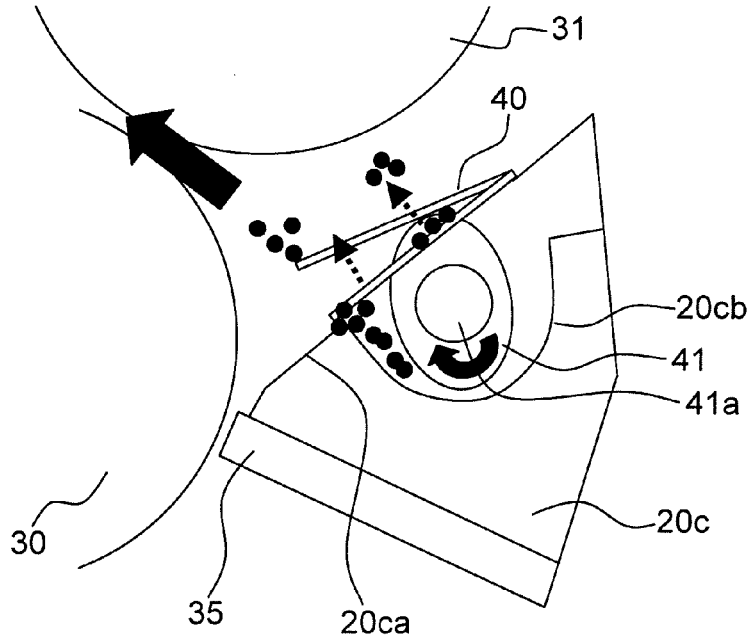
FIG. 8 is a schematic sectional side view illustrating operations of a film member and an oval roller, which are used in a developing device according to a second embodiment of the present invention.

FIG. 8 is a schematic sectional side view illustrating operations of a film member and an oval roller, which are used in a developing device according to a second embodiment of the present invention. Reference symbols common to those in FIG. 7 are assigned to portions common to those therein, and a description of the common portions is omitted. In this embodiment, in the oval roller 41, a cross section thereof is formed of one oval, and the film member 40 is formed of one substantially rectangular sheet. Other structures are similar to those in the first embodiment, and accordingly, a description thereof is omitted.

As illustrated in FIG. 8, a size of the oval roller 41 is set at such a size that allows, by the rotation of the oval roller 41, a circumferential surface of a large-diameter portion of the oval roller 41 to push up the film member 40 when the circumferential surface is opposed to the film member 40 and to release the push up for the film member 40 when a circumferential surface of a small-diameter portion of the oval roller 41 is opposed to the film member 40. Further, the recessed portion 20*cb* is formed of such a curved surface that allows the large-diameter portion of the oval roller 41 to pass above the recessed portion 20*cb* while being separated therefrom by a slight gap.

Then, when the oval roller 41 rotates, and the large-diameter portion of the oval roller 41 reaches a position opposed to the film member 40, the film member 40 is thereby pushed up, and when the small-diameter portion of the oval roller 41 reaches the position concerned, the push up for the film member 40 is thereby released. In such a way, the film member 40 vibrates in the direction perpendicular to the inner wall surface 20*ca*. By such vibrations, the deposition of the toner on the wall portion 20*c* can be prevented even in the case where the floating toner reaches the wall portion 20*c*. Therefore, the toner lack can be prevented, which is caused in such a manner that the toner deposited on the wall portion 20*c* falls and aggregates on the ear cutting blade 35.

Figure 9:
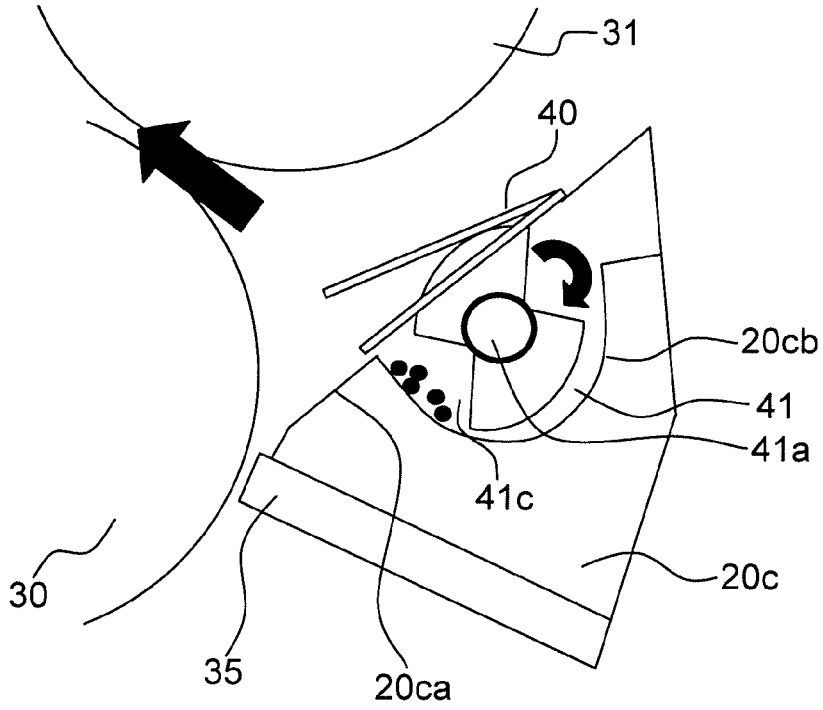
FIG. 9 is a schematic sectional side view illustrating peripheries of a film member and an oval roller, which are used in a developing device according to a third embodiment of the present invention.
Figure 10:
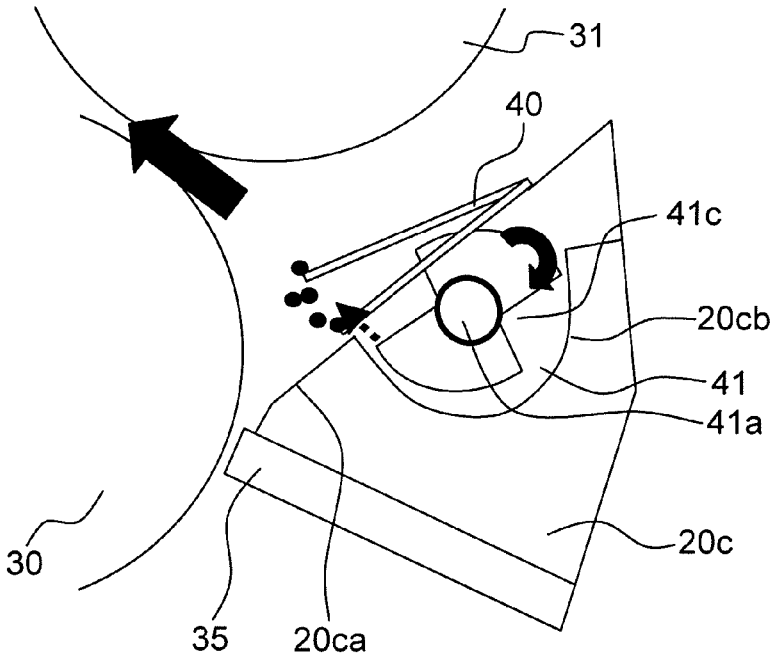
FIG. 10 is a schematic sectional side view illustrating a state in which the oval roller according to the third embodiment of the present invention scrapes out toner from a recessed portion.

FIG. 9 is a schematic sectional side view illustrating peripheries of a sheet member and an oval roller, which are used in a developing device according to a third embodiment of the present invention, and FIG. 10 is a schematic sectional side view illustrating a state in which notched portions of the oval roller scrape out the toner in the recessed portion. Reference symbols common to those in FIG. 7 are assigned to portions common to those therein, and a description of the common portions is omitted.

In this embodiment, on the circumferential surface of the oval roller 41, notched portions 41*c* are formed, which are capable of scraping out the toner that has entered the recessed portion 20*cb*. In such a way, the cross section of the oval roller 41 is formed of two substantial sectors arranged at positions point symmetric to each other with respect to the rotation shaft 41*a* as a center. Other structures are similar to those of the first embodiment, and accordingly, a description thereof is omitted.

As illustrated in FIG. 9, on the circumferential surface of the oval roller 41, the notched portions 41*c* with a substantially V-shape in cross section are formed along the longitudinal direction. In such a way, when the oval roller 41 rotates, a portion on the circumferential surface of the oval roller 41, on which the notched portions 41*c* are not formed, pushes up the film member 40 when the portion concerned is opposed to the film member 40, and the push up is released when the notched portions 41*c* are opposed to the film member 40. Further, when each of the notched portions 41*c* passes above the recessed portion 20*cb*, as illustrated in FIG. 10, the notched portion 41*c* can scrape out the toner that has entered the recessed portion 20*cb*.

In accordance with this embodiment, the notched portions 41*c* capable of scraping out the toner that has entered the recessed portion 20*cb* are formed on the oval roller 41, and hence the deposition of the toner on the recessed portion 20*cb* can be prevented. In such a way, the occurrence of the toner lack can be prevented, which is caused by the aggregation of the toner in the recessed portion 20*cb* and by the movement of the aggregated toner from the recessed portion 20*cb* into the developing container 20. Note that, it is also possible to scrape out the toner which has entered the recessed portion 20*cb* by appropriately setting an outer diameter of the protruding portions 41*b* of the above-mentioned first embodiment, and by appropriately setting an outer diameter of the large-diameter portion of the oval roller 41 of the second embodiment.

Figure 11:
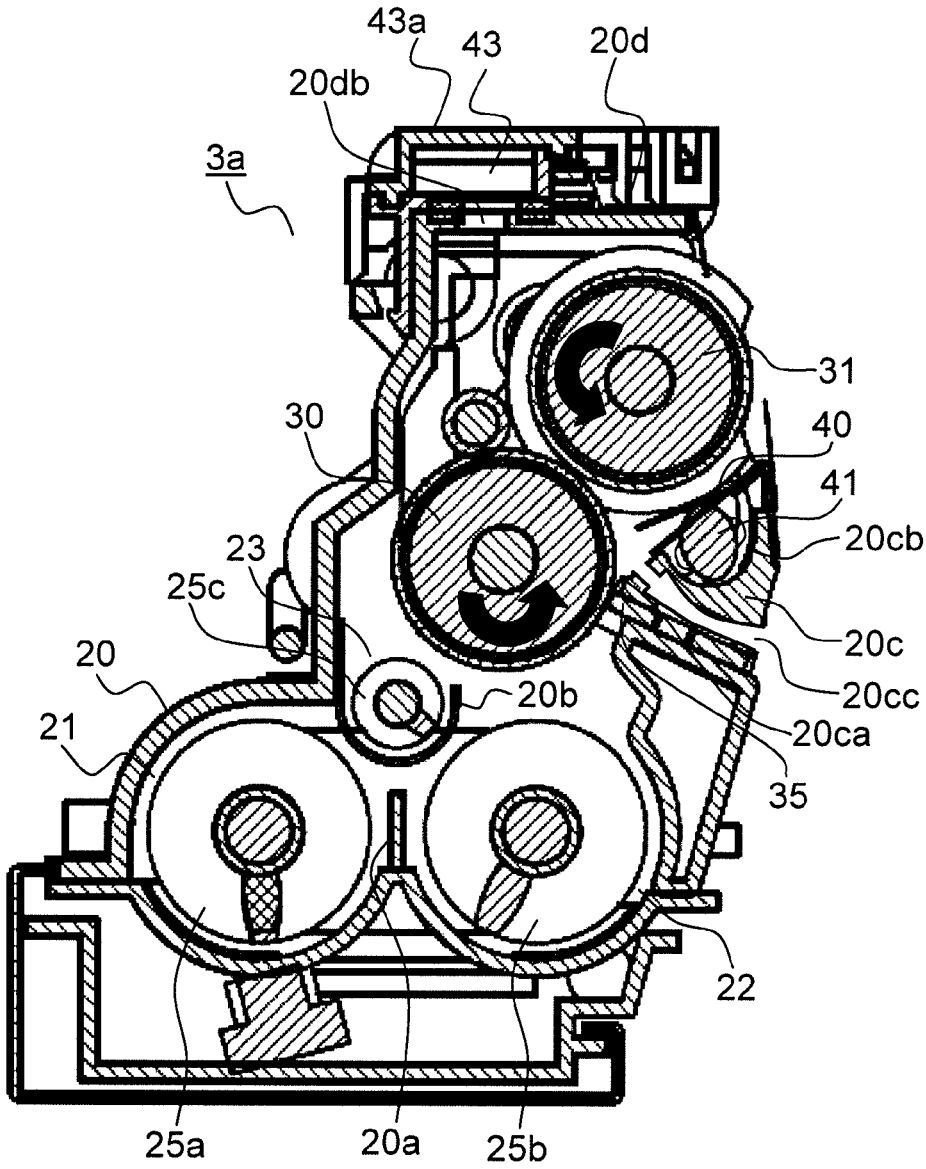
FIG. 11 is a schematic sectional side view illustrating a developing device according to a fourth embodiment of the present invention.

FIG. 11 is a sectional side view illustrating a developing device according to a fourth embodiment of the present invention. Reference symbols common to those in FIG. 2 are assigned to portions common to those therein, and a description of the common portions is omitted. As illustrated in FIG. 11, in this embodiment, in the wall portion 20*c*, through holes 20*cc* are formed, which allow the inside of the developing container 20 and the outside thereof to communicate to each other, and in an upper end portion of the developing container 20, air outflow ports 20*db* which communicate to a duct 43 are formed. Other structures are similar to those of the first embodiment, and accordingly, a description thereof is omitted.

As illustrated in FIG. 11, the through holes 20*cc* are formed into a shape of a plurality of slits along the longitudinal direction (direction perpendicular to the sheet plane of FIG. 11). In such a way, air flows into the inside of the developing container 20 from the outside thereof through the through holes 20*cc*, and as described above, such an airflow from the outside enters the vicinity of the ear cutting blade 35, of which pressure becomes negative by the airflow (see the solid arrow in FIG. 16) generated by the developing roller 31 and the magnetic roller 30, and then connects to the airflow thus generated. In such a way, even in the case where the toner separated from the wall portion 20*c* by the film member 40 falls on the periphery of the ear cutting blade 35, the toner can be borne on the airflow and can be sent upward.

Figure 12:
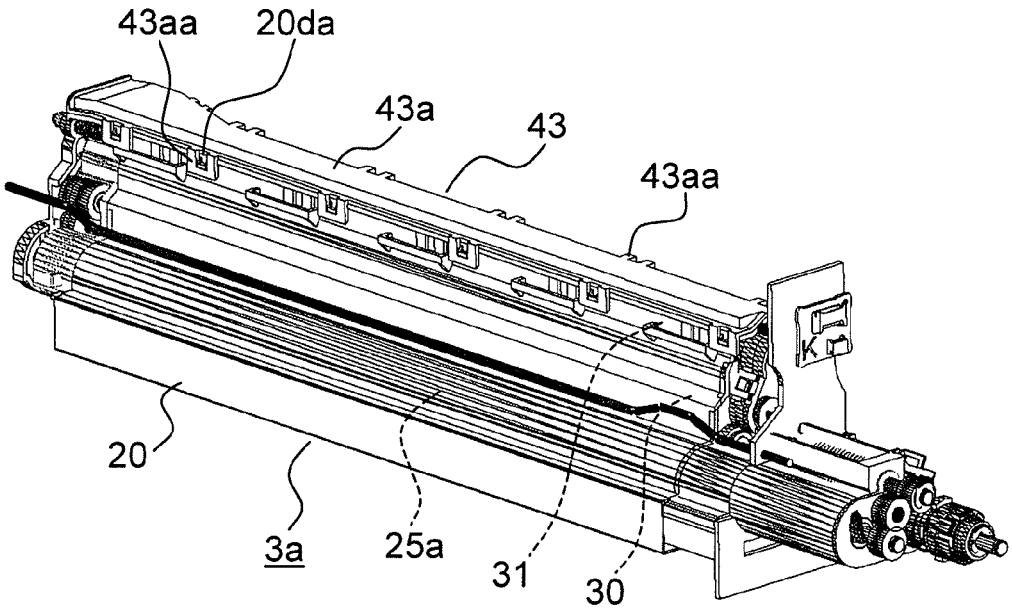
FIG. 12 is a schematic perspective view of the developing device according to the fourth embodiment of the present invention when viewed from the upper left of FIG. 11.
Figure 13:
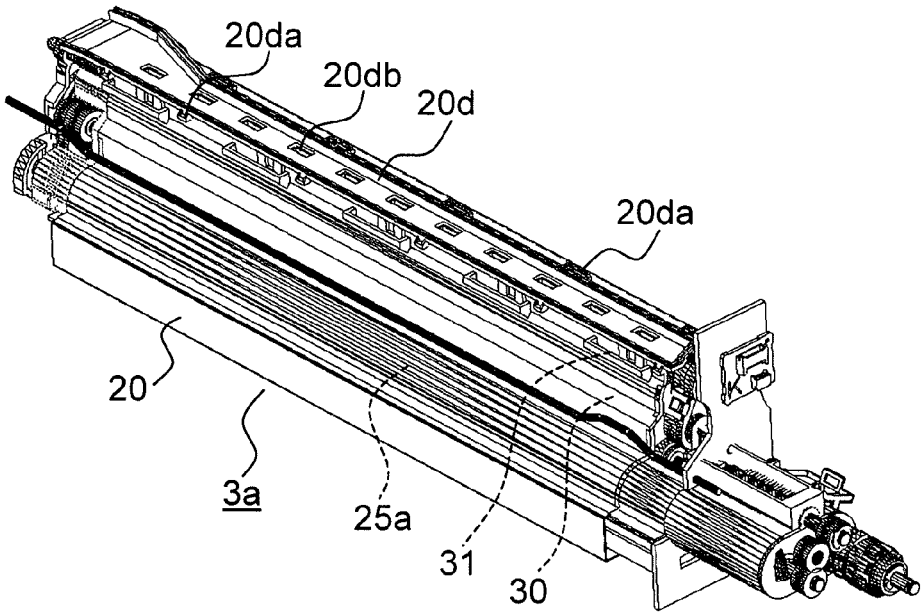
FIG. 13 is a view, in which a duct cover is omitted from FIG. 12, according to the fourth embodiment of the present invention.

Further, the duct 43 is formed above the developing container 20. The duct 43 is formed of an upper end portion 20*d* of the developing container 20 and a duct cover 43*a*. As illustrated in FIG. 12 and FIG. 13, engagement holes 43*aa* protruded downward from both end portions (on a depth side and front side in FIG. 12) of the duct cover 43 engage with hook-like hanging portions 20*da*, which are formed on the upper end portion 20*d*, in the direction perpendicular to the longitudinal direction. In this manner, the duct cover 43*a* is fixed to the upper end portion 20*d*.

Further, on the upper end portion 20*d*, a plurality of air outflow ports 20*db* which pass through the upper end portion 20*d* are formed along the longitudinal direction, and the air in the developing container 20 is exhausted to the duct 43 through the air outflow ports 20*db*.

Further, the duct 43 is connected to the exhaust fan 57 (see FIG. 1), and a filter (not shown) is provided between the exhaust fan 57 and the duct 43. The air exhausted from the developing container 20 to the duct 43 is guided by the duct 43, and is exhausted from the exhaust fan 57 to the outside of the apparatus main unit. At this time, the toner is collected to the above-mentioned filter.

Figure 14:
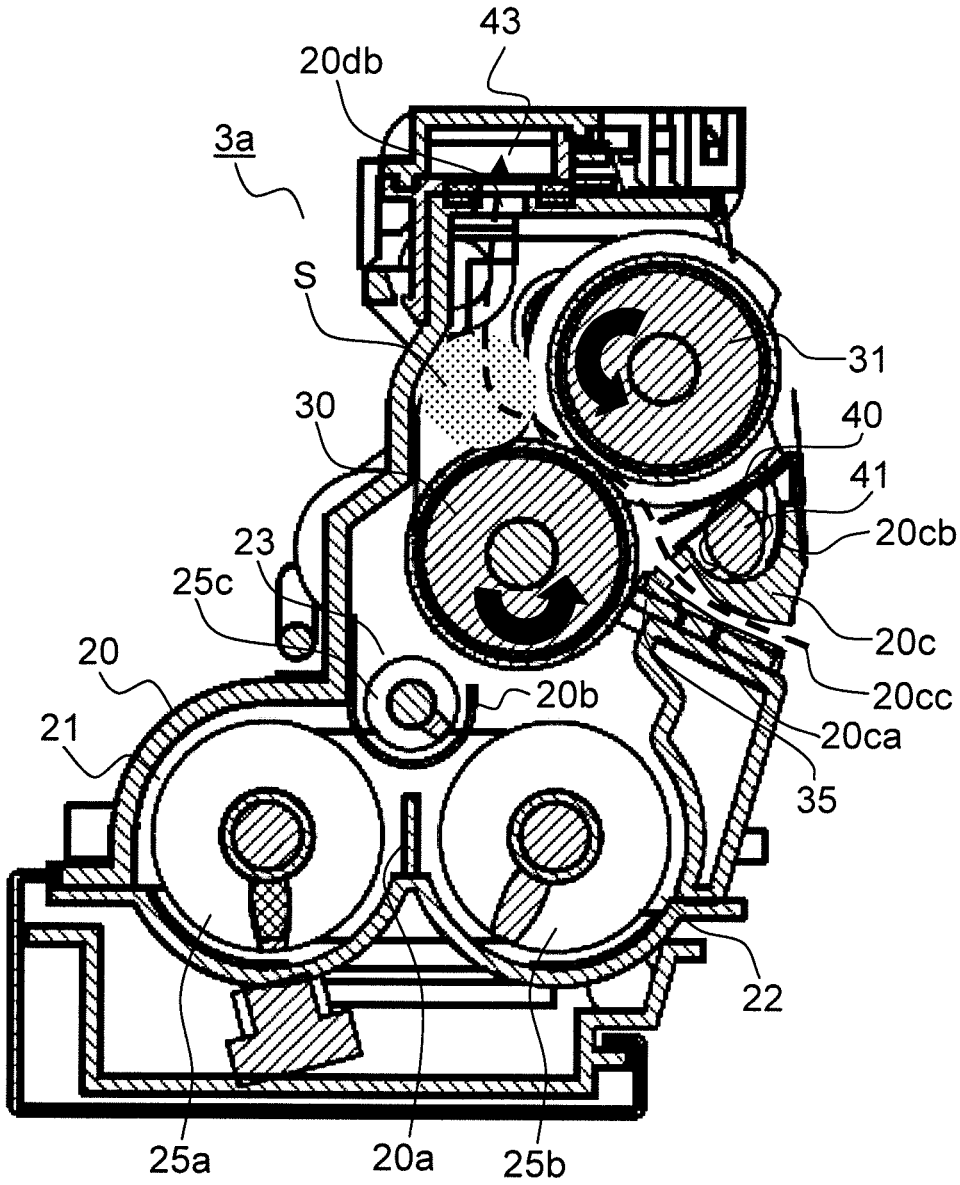
FIG. 14 is a schematic sectional side view illustrating a route of an airflow in a developing container according to the fourth embodiment of the present invention.

Here, as illustrated in FIG. 14, in the developing container 20, not only in a space surrounded by the developing roller 31, the magnetic roller 30, and the ear cutting blade 35 but also in a space S (periphery of a hatched region in FIG. 14) on an upstream side of the rotation direction of the developing roller 31 and a downstream side of the rotation direction of the magnetic roller 30 with respect to the opposing portion between the developing roller 31 and the magnetic roller 30, pressures thereof become positive. Therefore, there is a case where leakage of the toner occurs from the developing container 20 by such a pressure in the space S.

Further, in the space S, the toner that has not been used for the development is detached from the developing roller 31, and accordingly, among the toner thus detached, the toner which has not been collected on the magnetic roller 30 floats. Further, an amount of the floating toner is increased as a speed of developing processing is enhanced. Further, the pressure of the space S becomes positive to the largest extent in the developing container 20 by the flow of the air flowing into from the through holes 20*cc* formed in the wall portion 20*c*.

With regard to this point, in this embodiment, the air in the developing container 20 can be exhausted from the air outflow ports 20*db* through the duct 43 by the exhaust fan 57, and accordingly, the pressure of the space S, which becomes positive, can be decreased. Further, as illustrated by a broken arrow in FIG. 14, in the developing container 20, a route of an airflow is formed, which goes toward the air outflow ports 20*db* (upper left in FIG. 14) from the through holes 20*cc* formed in the wall portion 20*c*. In such a way, the toner floating in the vicinity of the wall portion 20*c* can be borne on the route thus formed, can be exhausted from the air outflow ports 20*db*, and can be collected by the filter (not shown) provided between the exhaust fan 57 and the duct 43.

As described above, in this embodiment, the developing container 20 is configured to include the wall portion 20*c*, which is opposed to the developing roller 31, between the ear cutting blade 35 and the opposing region between the photosensitive drum 1*a* and the developing roller 31. In addition, the developing container 20 further includes the through holes 20*cc* which are arranged in the wall portion 20*c* and allow the inside of the developing container 20 and the outside thereof to communicate to each other, and the duct 43. Further, there are provided the exhaust fan 57 that exhausts the air in the developing container 20 to the outside of the apparatus main unit (color printer 100), and the air outflow ports 20*db* which are arranged on the upper end portion of the developing container 20 and also above the boundary between the developing roller 31 and the magnetic roller 30, the air outflow ports 20*db* communicating to the duct 43. Accordingly, in the developing device 3*a*, the route of the airflow, which reaches the air outflow ports 20*db* from the through holes 20*cc*, can be formed.

In such a way, the toner floating in the developing container 20 can be sent from the wall portion 20*c* to the upper end portion 20*d*, and can be exhausted from the developing container 20 to the exhaust fan 57 through the air outflow ports 20*db*. Therefore, the leakage of the toner from the developing device 3*a* and the deposition of the toner in the developing device 3*a* can be effectively prevented.

Figure 15:
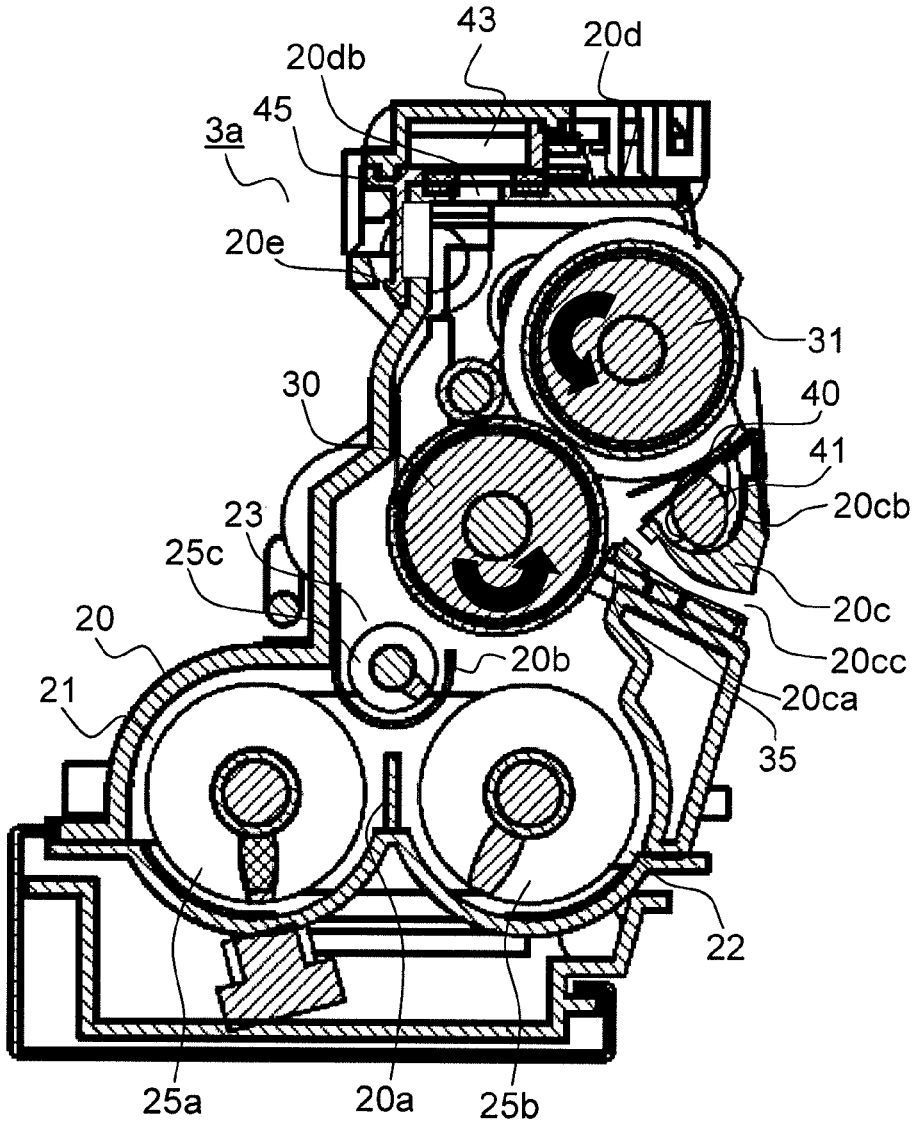
FIG. 15 is a schematic sectional side view illustrating a developing device according to a fifth embodiment of the present invention.

FIG. 15 is a schematic sectional side view illustrating a developing device for use in an image forming apparatus according to a fifth embodiment of the present invention. Reference symbols common to those in FIG. 11 are assigned to portions common to those therein, and a description of the common portions is omitted. In this embodiment, a dust detection sensor (detection portion) 45 is provided in the vicinity of the air outflow port 20*db*. Other structures are similar to those in the fourth embodiment, and accordingly, a description thereof is omitted.

As illustrated in FIG. 15, in a left wall 20*e* immediately under the upper end portion 20*d* of the developing container 20, the dust detection sensor 45 is provided, which detects the amount of floating toner. The dust detection sensor 45 irradiates the toner (dust) with light, measures intensity of scattered light from the toner, converts the intensity of the scattered light into a concentration of the dust, and can thereby measure the concentration of the dust in the air.

Based on a detection result (concentration of the dust) of the dust detection sensor 45 as described above, a scattered amount of the toner in the developing container 20 can be calculated. Therefore, by the control portion (not shown), activation of the exhaust fan 57 and stop of the activation are switched or the number of revolutions and drive time thereof are controlled based on a detection result of the dust detection sensor 45. In this manner, the discharge of the toner from the developing container 20 can be adjusted depending on the scattered amount of the toner in the developing container 20. In such a way, it becomes possible to efficiently discharge the toner from the developing container 20.

Besides the above, the present invention is not limited to the above-mentioned embodiments, and is modifiable in various ways within the scope without departing from the spirit of the present invention. For example, the film member 40 and the oval roller 41, which are illustrated in the above-mentioned embodiments, are merely examples, and are not particularly limited to the above-mentioned embodiments. Those can be appropriately set in accordance with the apparatus structure and the like.

Further, the shape, size and the like of the through holes 20*cc* and the air outflow ports 20*db*, which are illustrated in the above-mentioned embodiments, can be appropriately set depending on the scattered amount of the toner and a formed situation of the route of the airflow in the developing container 20, discharge states of the air and the toner to the exhaust fan 57, and the like, and are not particularly limited.

Further, each of the above-mentioned embodiments is applied to the developing devices 3*a* to 3*d*, each of which uses the two-component developer, forms the magnetic brush on the magnetic roller 30, moves only the toner from the magnetic roller 30 to the developing roller 31, and supplies the toner from the developing roller 31 to each of the photosensitive drums 1*a* to 1*d*. However, besides the above, each of the above-mentioned embodiments can also be applied to a developing device using a one-component developer, to a developing device in which the magnetic roller 30 is not provided and only the developing roller 31 is provided, and to the like. Further, in each of the above-mentioned embodiments, the tandem color image forming apparatus 100 is used. However, besides the above, the present invention can also be applied, for example, to a copier, a multifunction peripheral, and a facsimile machine, and needless to say, to monochrome multifunction peripheral, printer, facsimile machine, and the like.

What is claimed is:

1. A developing device comprising:

a toner carrying member for supplying toner to an image bearing member at an opposing region opposing the image bearing member, the toner carrying member being arranged so as to be opposed to the image bearing member on which an electrostatic latent image is to be formed;

a toner supply member for supplying only the toner to the toner carrying member, the toner supply member having a developer containing the toner and a carrier carried thereon;

a blade for regulating an amount of the developer carried on the toner supply member;

a casing for housing the toner carrying member, the toner supply member, and the blade, the casing including a wall portion opposed to the toner carrying member between the blade and the opposing region;

a sheet member that is flexible, is provided on the wall portion, has a free end, forms a part of an inner wall surface of the wall portion, and is movable in a direction perpendicular to the inner wall surface; and a moving portion provided on the wall portion, for moving the sheet member, wherein the wall portion has a recessed portion recessed from the inner wall surface side formed thereon;

the moving portion comprises an oval roller provided in the recessed portion; and the sheet member is arranged at a position covering the recessed portion, and moves by being pressed against a circumferential surface of the oval roller.

2. A developing device according to claim 1, wherein a plurality of protruding portions with substantially a same shape are formed on a circumferential surface of the oval roller along a circumferential direction and an axial direction of the oval roller while being alternately angled.

3. A developing device according to claim 2, wherein:

the sheet member is divided into a plurality of sheet pieces in the axial direction, and a length of each of the plurality of sheet pieces in the axial direction is the same as a length of each of the plurality of protruding portions in the axial direction; and the plurality of sheet pieces are formed at positions overlapping the plurality of protruding portions in the axial direction.

4. An image forming apparatus comprising:

an image bearing member on which an electrostatic latent image is to be formed; and a developing device including:

a toner carrying member for supplying toner to the image bearing member at an opposing region opposing the image bearing member, the toner carrying member being arranged so as to be opposed to the image bearing member, a toner supply member for supplying only the toner to the toner carrying member, the toner supply member having a developer containing the toner and a carrier carried thereon, a blade for regulating an amount of the developer carried on the toner supply member, a casing for housing the toner carrying member, the toner supply member, and the blade, the casing including a wall portion opposed to the toner carrying member between the blade and the opposing region, a sheet member that is flexible, is provided on the wall portion, has a free end, forms a part of an inner wall surface of the wall portion, and is movable in a direction perpendicular to the inner wall surface, and a moving portion provided on the wall portion, for moving the sheet member, wherein the wall portion is arranged to provide a through hole for allowing an inside of the casing and an outside of the casing to communicate with each other;

the image forming apparatus includes an exhaust portion for exhausting air in the casing to outside of a main unit thereof, the exhaust portion having a duct;

an upper end portion of the casing has an air exhaust port that is above an opposing part between the toner carrying member and the toner supply member, and that communicates with the duct;

the wall portion has a recessed portion recessed from the inner wall surface side formed thereon;

the moving portion comprises an oval roller provided in the recessed portion; and the sheet member is arranged at a position covering the recessed portion, and moves by being pressed against a circumferential surface of the oval roller.

5. An image forming apparatus according to claim 4, wherein a plurality of protruding portions with substantially a same shape are formed on a circumferential surface of the oval roller along a circumferential direction and an axial direction of the oval roller while being alternately angled.

6. An image forming apparatus according to claim 5, wherein:

the sheet member is divided into a plurality of sheet pieces in the axial direction, and a length of each of the plurality of sheet pieces in the axial direction is the same as a length of each of the plurality of protruding portions in the axial direction; and the plurality of sheet pieces are formed at positions overlapping the plurality of protruding portions in the axial direction.

7. A developing device comprising:

a developer carrying member for supplying a developer to an image bearing member at an opposing region opposing the image bearing member, the developer carrying member being arranged so as to be opposed to the image bearing member on which an electrostatic latent image is to be formed;

a blade for regulating an amount of the developer carried on the developer carrying member;

a casing for housing the developer carrying member and the blade, the casing including a wall portion opposed to the developer carrying member between the blade and the opposing region;

a sheet member that is flexible, is provided on the wall portion, has a free end, forms a part of an inner wall surface of the wall portion, and is movable in a direction perpendicular to the inner wall surface; and a moving portion provided on the wall portion, for moving the sheet member, wherein the wall portion has a recessed portion recessed from the inner wall surface side formed thereon;

the moving portion comprises an oval roller provided in the recessed portion; and the sheet member is arranged at a position covering the recessed portion, and moves by being pressed against a circumferential surface of the oval roller.

8. A developing device according to claim 7, wherein a plurality of protruding portions with substantially a same shape are formed on a circumferential surface of the oval roller along a circumferential direction and an axial direction of the oval roller while being alternately angled.

9. A developing device according to claim 8, wherein:

the sheet member is divided into a plurality of sheet pieces in the axial direction, and a length of each of the plurality of sheet pieces in the axial direction is the same as a length of each of the plurality of protruding portions in the axial direction; and the plurality of sheet pieces are formed at positions overlapping the plurality of protruding portions in the axial direction.

* * * * *